United States Patent [19]

Fastner et al.

[11] 4,064,925

[45] Dec. 27, 1977

[54] CONTINUOUS CASTING METHOD AND APPARATUS

[75] Inventors: Thorwald Fastner; Alois Niedermayr, both of Linz; Johann Nakesch, Pasching; Max Türmer, Linz, all of Austria

[73] Assignee: Vereinigte Osterreichische Eisen- und Stahlwerke-Alpine Montan Aktiengesellschaft, Linz, Austria

[21] Appl. No.: 659,920

[22] Filed: Feb. 20, 1976

[30] Foreign Application Priority Data

Feb. 25, 1975 Austria ..... 1402/75

[51] Int. Cl.[2] ..... B22D 11/10

[52] U.S. Cl. ..... 164/66; 164/82; 164/259; 164/437; 164/337; 266/220; 266/236

[58] Field of Search ..... 164/66, 259, 335, 337, 164/82, 281; 266/220, 236; 222/603

[56] References Cited

U.S. PATENT DOCUMENTS

| | | | |
|---|---|---|---|
| 3,083,422 | 4/1963 | Finkl | 164/66 X |
| 3,145,095 | 8/1964 | Franzer | 266/220 X |
| 3,392,009 | 7/1968 | Holmes et al. | 164/66 X |
| 3,608,621 | 9/1971 | Bollig et al. | 164/337 X |
| 3,886,992 | 6/1975 | Maas et al. | 164/66 X |
| 3,888,294 | 6/1975 | Fastner et al. | 164/66 |
| 3,908,744 | 9/1975 | Fastner | 164/281 |

*Primary Examiner*—Ronald J. Shore
*Attorney, Agent, or Firm*—Brumbaugh, Graves, Donohue & Raymond

[57] ABSTRACT

In a method of and an apparatus for treating metal melts with flush gas during continuous casting, the molten metal is led from a tundish having an outflow opening into a mold, while inert flush gas is supplied above the outflow opening of the tundish at a rate of between 30 and 300 Nl per minute, so that the upwardly rising gas bubbles prevent slag particles present on the surface of the metal bath in the tundish from being sucked into the metal stream.

6 Claims, 2 Drawing Figures

CONTINUOUS CASTING METHOD AND APPARATUS

BACKGROUND OF THE INVENTION

The invention relates to a method of treating metal melts with flush gas during continuous casting, wherein the molten metal is led from a tundish having an outflow opening and, if desired, a casting tube, into a mould, as well as to an apparatus for carrying out this method.

Generally speaking, continuosly cast slabs have a very uniform quality over their entire lengths. In some areas, however, there may be local quality deteriorations due to the pollution of the edge zone by slag inclusions which pollution would lead to high scarfing losses. Such quality changes may, among other things, be caused by a lowered level of the bath in the tundish.

If the casting level in the tundish falls below a certian level, suction and eddies form in the outlet area that are so strong that the covering slag floating on the metal bath together with liberated inclusions, is sucked into the casting tube and gets into the strand. This critical level of the bath depends on the amount of steel flowing out per time unit. When the casting performance is increased, e.g. 3.0 metric tons/minute, suction phenomena may occur up to a casting level height of 300 mm.

Although attempts are made to keep the level of the bath as high as possible during the whole casting procedure, the level of the bath cannot be prevented from sinking from time to time. Such a sinking will occur, e.g. when the outlet of the casting ladle narrows, when ladle outlets must be burnt out, when the ferrostatic pressure in the casting ladle decreases towards the end of casting, when samples are taken from the casting stream and when successive castings are carried out during the exchange of the ladle.

SUMMARY OF THE INVENTION

It is the object of the invention to overcome these difficulties and disadvantages and to create a method of treating metal melts during continuous casting which allows for a temporary lowering of the level of the bath without a deterioration of the quality of the strand surface.

According to the invention, this object is achieved in that inert flush gas, preferably nitrogen, is supplied above the outflow opening of the tundish in an amount equal to at least 30 Nl and at most 300 Nl per minute. The gas bubbles rise upwardly and prevent the slag particles on the metal bath surface in the tundish from being sucked into the metal current leaving through the outflow opening of the tundish. Suitably, the flush gas is supplied at a distance above the outflow opening; of the tundish, which distance corresponds to at least half of the outflow opening diameter.

By introducing the flush gas sufficiently high above the outflow opening it is assured that the flush gas can rise upwardly only and cannot be taken downward by the metal current. Thus, the rising gas bubbles constitute a barrier for the slag particles which, compared with the metal, have a lower specific gravity and are thus prevented from entering the current.

It is an advantage, if the flush gas is supplied during the entire casting procedure. This also constitutes a preventive measure against the creation of a critical situation by a sudden sinking of the level of the bath.

For carrying out the method according to the invention, a tube or a hollow stopper is arranged above the outflow opening and has a ring of holes or bores. The stopper or tube is connected to a flush gas conduit.

Suitably, the ring of holes or bores is arranged at a distance above the outflow opening corresponding to at least half the diameter of the outflow opening.

BRIEF DESCRIPTION OF THE DRAWINGS

The method and the apparatus for carrying out the method shall now be described in more detail and with reference to the accompanying drawings, wherein.

DESCRIPTION OF A PREFERRED EMBODIMENT

Figure 1:
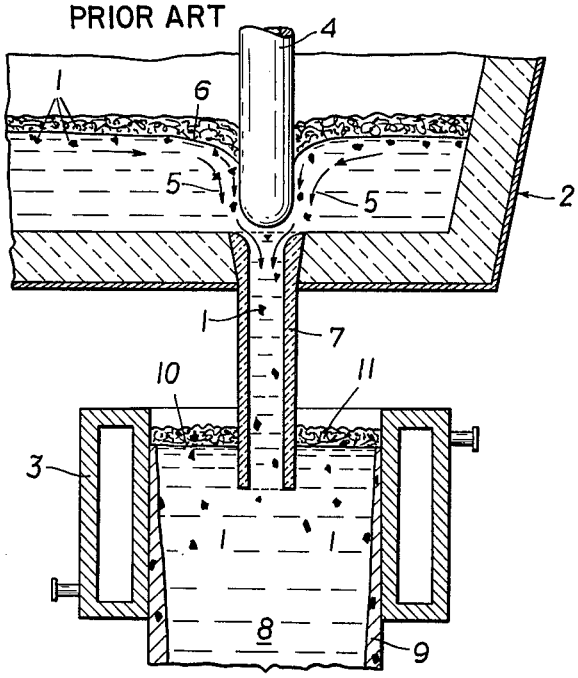
FIG. 1 PRIOR ART
FIG. 1 shows the continuous casting of metals in the common manner.

FIG. 1 schematically illustrates the situation where slag particles 1 are drawn from a tundish 2 into a mould 3. The amount of metal flowing out of the tundish is controlled by a stopper 4. In the outflow area of the tundish the steel 5 near the casting level 6, together with slag particles flows through a casting tube 7 into the sump 8 of a strand 9. From the sump 8 of the strand 9 some of the slag particles 1 reach the casting level 10 and are accommodated by a slag 11 located on the surface of the metal bath. The remaining slag particles 1, however, get stuck on the strand skin and are included by the solidifying steel.

Figure 2:
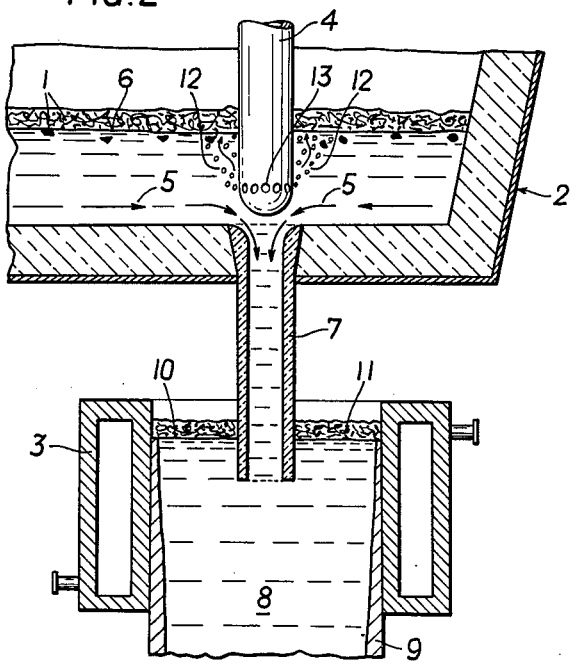
FIG. 2 shows the conntinuous casting of metals using the measures according to the invention.

FIG. 2 shows the flow of the steel in a casting installation provided with a means for carrying out the method of the invention. Flush gas 12 emerges laterally from a ring of bores 13 provided around the hollow stopper 4. The gas bubbles rise upwardly and prevent a downwardly directed current from forming at the bath surface. The steel 5 thus flows out of the tundish via the casting tube 7 from the layers of metal near the casting bottom which do not come into contact with the flush gas Thus, there is no longer the danger that slag can be drawn into the strand.

In continuous casting sliders are often used instead of stoppers for regulating the amount of metal flowing through the tundish. If a stopper is not available for the supply of the flush gas, the gas is introduced into the steel via a refractory tube designed similar to the stopper.

The amount of gas necessary to prevent the downward flow amounts to at least 30 Nl/min. An amount exceeding 300 Nl/min. (liters per minute under standard conditions of temperature and pressure) is not suitable, because then a splashing of steel would occur. An inert gas, preferably nitrogen, is used.

What we claim is:

1. A continuous casting method of treating metal salts with flush gas, which comprises the steps of:

supplying molten metal contained in a tundish and covered by a layer of slag particles into a continuous casting mould through an outflow opening in said tundish, introducing an inert flush gas at a distance above the outflow opening in said tundish during casting, said distance being equal to at least half the diameter of the outflow opening, and adjusting the amount of inert flush gas introduced to from at least 30 Nl to at most 300 Nl per minute, to form upwardly rising gas bubbles in said tundish, thereby preventing slag particles from being supplied to the mould together with the molten metal.

2. A method as set forth in claim 1, wherein the molten metal is supplied into the mould via a casting tube provided at the outflow opening of said tundish.

3. A method as set forth in claim 1, wherein the inert flush gas is nitrogen.

4. In a continuous casting apparatus with a tundish having an outflow opening and a mould, the improvement comprising a flush gas supply means arranged above the outflow opening in said tundish, which flush gas supply means comprises a gas supply tube with a ring of holes for introducing flush gas into said tundish during casting and a flush gas source connected to said holes, the flush gas source supplying between 30 and 300 Nl per minute of flush gas during casting and the ring of holes being arranged at a distance above the outflow opening in said tundish equal to at least half the diameter of said outflow opening.

5. An apparatus as set forth in claim 4, wherein said flush gas supply means is a hollow stopper.

6. An apparatus as set forth in claim 4, further comprising a casting tube at the outflow opening of said tundish.

* * * * *

UNITED STATES PATENT AND TRADEMARK OFFICE

CERTIFICATE OF CORRECTION

PATENT NO. : 4,064,925

DATED : Dec. 27, 1977

INVENTOR(S) : Fastner et al.

It is certified that error appears in the above-identified patent and that said Letters Patent are hereby corrected as shown below:

Col. 1, line 12, "continuosly" should read --continuously--; lines 15 & 16, after "inclusions" insert a comma; line 19, "certian" should read --certain--; line 22, after "bath" insert a comma; line 55, "opening; of the" should read --opening of the--.

Col. 2, line 15, "conntinuous" should read --continuous--; line 25, after "particles" insert a comma; line 50, after "30 Nl min" insert --(liters per minute under standard conditions of temperature and pressure)--; lines 51 & 52, after "300 Nl/min." delete "(liters per minute under standard conditions of temperature and pressure)"; and line 56, "metal salts" should read --metal melts--.

Signed and Sealed this

Second Day of May 1978

[SEAL]

Attest:

RUTH C. MASON
Attesting Officer

LUTRELLE F. PARKER
Acting Commissioner of Patents and Trademarks